US012805624B2

(12) United States Patent
Rawlinson et al.

(10) Patent No.: US 12,805,624 B2
(45) Date of Patent: Nov. 24, 2026

(54) MASKING APPARATUS FOR SHIELDING A FINGER

(71) Applicant: SPIN MASTER LTD., Toronto (CA)

(72) Inventors: Rochelle Marie Rawlinson, Toronto (CA); Taylor Ann Hutchins, Toronto (CA); Mollie Jameson, Toronto (CA); Graham Browning, Toronto (CA); Emma Peat, Toronto (CA)

(73) Assignee: SPIN MASTER LTD., Toronto (CA)

( * ) Notice: Subject to any disclaimer, the term of this patent is extended or adjusted under 35 U.S.C. 154(b) by 187 days.

(21) Appl. No.: 18/520,839

(22) Filed: Nov. 28, 2023

(65) Prior Publication Data

US 2025/0169591 A1 May 29, 2025

(51) Int. Cl.
*A45D 29/00* (2006.01)

(52) U.S. Cl.
CPC ..... *A45D 29/004* (2013.01)

(58) Field of Classification Search
CPC ..... A45D 29/00; A45D 29/004; A45D 29/22
USPC ..... 132/285
See application file for complete search history.

(56) References Cited

U.S. PATENT DOCUMENTS 2,031,225 A 2/1936 O'Donnell
2,209,167 A * 7/1940 McKinney ..... A45D 29/004 132/75.3
2,283,703 A * 5/1942 Stedman ..... A45D 29/004 132/285
2,485,384 A * 10/1949 Klein ..... A45D 29/004 132/285
2,518,391 A * 8/1950 Smidl ..... A45D 29/004 132/285
2,654,375 A * 10/1953 Frank ..... A45D 29/004 132/285
2,709,443 A 5/1955 Brite
(Continued)

FOREIGN PATENT DOCUMENTS

DE 29912724 U1 * 12/1999 ..... A45D 29/004
KR 20100068578 A 6/2010
(Continued)

OTHER PUBLICATIONS

Clarivate Analytics translation of DE 29912724 U1 (Year: 1999).*
(Continued)

*Primary Examiner* — Edelmira Bosques
*Assistant Examiner* — Jennifer P Connell
(74) *Attorney, Agent, or Firm* — Aird & Berlis LLP

(57) ABSTRACT

A masking apparatus for shielding a finger of a user is provided herein. The masking apparatus is structure to shield the finger of the user when a product is being applied to a fingernail on the finger of the user. The masking apparatus includes a base for supporting the finger of the user, and a cover member that is connected to the base and is made from an elastic material so as to be elastically stretchable. The underside of the cover member has a selected coefficient of friction to engage the finger of the user around the fingernail to protect the portion of the finger of the user around the fingernail. The masking apparatus can be repositioned between loading and use positions so that the cover member is cleanly separated from the finger of the user to prevent smudging of the product on the fingernail by the cover member.

17 Claims, 8 Drawing Sheets

(56) References Cited

U.S. PATENT DOCUMENTS

| | | | | |
|---|---|---|---|---|
| 2,840,088 | A * | 6/1958 | Kushner | A45D 29/004 132/285 |
| 3,515,154 | A | 6/1970 | Morgese | |
| 4,966,174 | A * | 10/1990 | Stanczak | A45D 29/00 2/21 |
| D403,124 | S | 12/1998 | Wacker | |
| 6,200,055 | B1 | 3/2001 | Fusaro, Jr. | |
| D445,322 | S | 7/2001 | Hames | |
| D497,454 | S | 10/2004 | Lin | |
| 8,499,970 | B2 | 8/2013 | Yoo | |
| D698,090 | S | 1/2014 | Smith | |
| 8,752,563 | B2 | 6/2014 | Lieu | |
| D828,960 | S | 9/2018 | Shugar | |
| D841,234 | S | 2/2019 | Laaly | |
| 10,206,484 | B2 | 2/2019 | Wilson et al. | |
| D890,990 | S | 7/2020 | Sarro | |
| D911,616 | S | 2/2021 | Xiao | |
| D989,399 | S | 6/2023 | Wilson-Brooks | |
| D1,022,335 | S | 4/2024 | Xue | |
| D1,044,968 | S | 10/2024 | Cai | |
| 12,186,942 | B1 | 1/2025 | Phung | |
| 2001/0037814 | A1* | 11/2001 | Meinschewnk | A41D 13/087 132/73 |
| 2010/0313904 | A1 | 12/2010 | Garinger | |
| 2012/0321368 | A1 | 12/2012 | Lim | |
| 2014/0325728 | A1* | 11/2014 | Albera | A41D 13/081 2/455 |
| 2015/0257507 | A1 | 9/2015 | Parkly | |
| 2017/0027300 | A1 | 2/2017 | Saman et al. | |
| 2018/0303218 | A1* | 10/2018 | Tarrant | A45D 29/04 |
| 2019/0098983 | A1* | 4/2019 | Matalon | A61Q 3/00 |
| 2019/0166972 | A1 | 6/2019 | Walia et al. | |
| 2020/0022477 | A1 | 1/2020 | Yun | |
| 2020/0077764 | A1 | 3/2020 | Peat et al. | |
| 2021/0386179 | A1 | 12/2021 | Yilmax | |
| 2022/0015521 | A1 | 1/2022 | Wilson-Brooks et al. | |
| 2022/0330685 | A1 | 10/2022 | Xu | |
| 2023/0148730 | A1* | 5/2023 | Lam | A45D 29/004 132/73 |
| 2023/0191778 | A1 | 6/2023 | Yamasaki | |

FOREIGN PATENT DOCUMENTS

| | | | | |
|---|---|---|---|---|
| KR | 101330081 | B1 * | 11/2013 | A45D 29/18 |
| WO | WO2015181219 | A1 | 12/2015 | |
| WO | WO-2016026500 | A1 * | 2/2016 | A45D 29/18 |

OTHER PUBLICATIONS

Clarivate Analytics translation of KR 101330081 (Year: 2013).*

Cool Maker—Go Glam Nail Studio [online]; [review published Jul. 26, 2021]; [retrieved from internet Mar. 21, 2026]; URL: https://www.target.com/p/cool-maker-go-glam-nail-studio/-/A-8 995728 1 (9 pages). (Year: 2021).

U.S. Appl. No. 29/918,928: Examiner Report dated Mar. 27, 2026.

U.S. Appl. No. 29/918,932: Examiner Report dated Apr. 8, 2026.

U.S. Appl. No. 29/918,935: Examiner Report dated May 8, 2026.

U.S. Appl. No. 29/919,068: Examiner Report dated Apr. 8, 2026.

* cited by examiner

MASKING APPARATUS FOR SHIELDING A FINGER

FIELD OF THE DISCLOSURE

The present disclosure relates generally to cosmetic skin protectors and more specifically to a masking apparatus for shielding a finger of a user when a product is being applied to a fingernail on the finger of the user.

BACKGROUND OF THE DISCLOSURE

The present disclosure relates to finger shields which are useful for protecting fingers during the application of a product, such as a liquid coating, to a fingernail on a finger. It is common practice for individuals to enhance and beautify their fingernails through the application of color or other finishes on the outer surface of the fingernail. This application may be done through the use of various nail enamels, nail polishes or similar cosmetic products. A common contemporary method of applying such polishes is done by applying the nail polish to the surface of the fingernail with an applicator brush.

It is desirable to apply the polish in a manner which results in a clean appearance. Since the polish typically spreads along the fingernail, extreme care must be exercised in applying the polish to achieve the clean appearance of the finished nail. Application of the polish onto the fingernail may be further complicated when applying the polish with a non-dominant hand. For instance, it may be difficult for a right-handed individual to apply nail polish to a fingernail on the right hand using the non-dominant left hand, and conversely, it may be difficult for a left-handed individual to apply nail polish to a fingernail on the left hand using the non-dominant right hand. Furthermore, application of polish may be difficult for those lacking dexterity or coordination. For example, young children or teenagers who are inexperienced in applying polish may struggle in keeping polish away from the skin surrounding the fingernail. In the event that polish is inadvertently applied to the skin or spread onto the skin while the polish is drying, and the polish is not cleaned from the skin, the resultant appearance may be sloppy or careless and the polish that has spread onto the skin may cause irritation or drying of the skin.

Accordingly, there is a need for an apparatus which simplifies the process of applying nail polish by protecting the skin surrounding the fingernail during application of the nail polish thereto. Various aspects of the present disclosure address this particular need, as will be discussed in more detail below.

SUMMARY OF THE DISCLOSURE

According to an aspect, there is provided a masking apparatus for shielding a finger of a user when a product is being applied to a fingernail on the finger of the user, the masking apparatus comprises a base that includes a finger rest, the finger rest being formed to support the finger of the user, and a cover member that is connected to the base, wherein the cover member has a through-aperture that is formed therein, and is made from an elastic material so as to be elastically stretchable from an un-extended position to an extended position so as to position the through-aperture at least partially over the fingernail, when the finger of the user is placed on the base, wherein the cover member includes an engagement portion that has an underside that is positioned to engage a proximal portion of the finger of the user that is proximal relative to the fingernail when the cover member is in the extended position, and wherein the underside has a selected coefficient of friction with human skin so as to retain the cover member in the extended position by friction during engagement of the underside with the proximal portion of the finger of the user.

According to another aspect, there is provided a method of using a masking apparatus to shield a finger of a user when applying a product to a fingernail on the finger of the user, the method comprising: resting the finger of the user on a base of the masking apparatus, stretching an elastic cover member of the masking apparatus from an un-extended position to an extended position such that a through-aperture formed in the elastic cover member is at least partially positioned over the fingernail on the finger of the user, the elastic cover member being connected to the base of the masking apparatus for stretching between the un-extended and extended positions, and manipulating the elastic cover member of the masking apparatus such that an underside of the elastic cover member is brought into contact with a proximal portion of the finger of the user that is proximal to the fingernail on the finger of the user, the underside of the elastic cover member having a selected coefficient of friction with human skin so as to retain the elastic cover member in the extended position by friction during contact of the underside of the elastic cover member with the proximal portion of the finger of the user.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
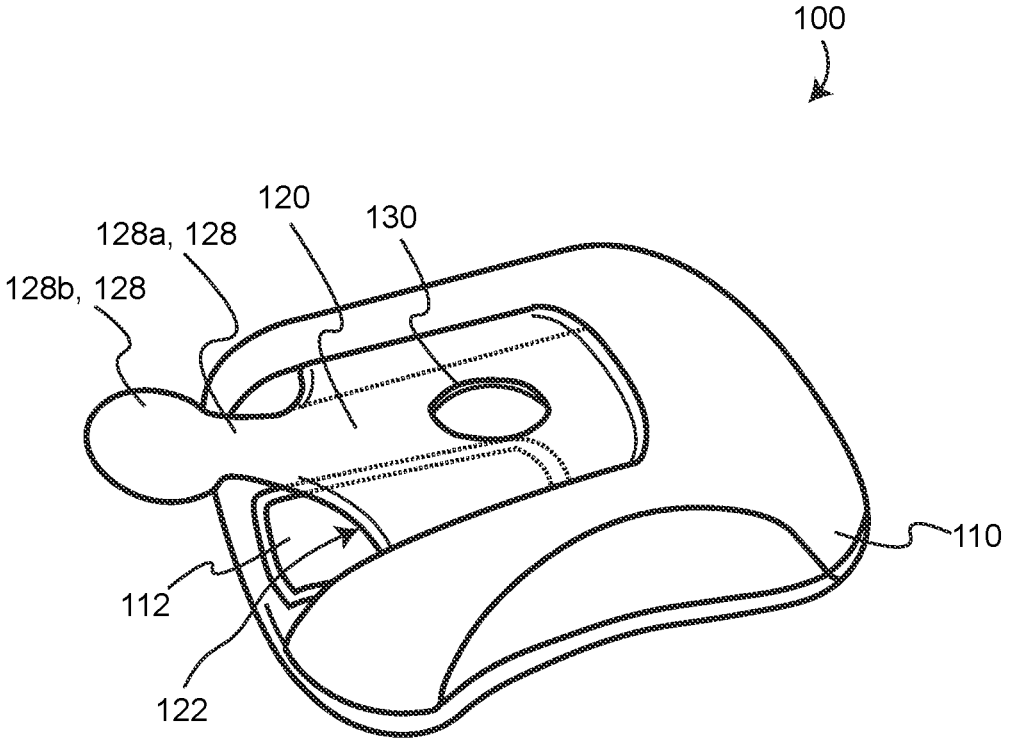
FIG. 1 is a perspective view of the masking apparatus according to an embodiment of the present disclosure.
Figure 2A:
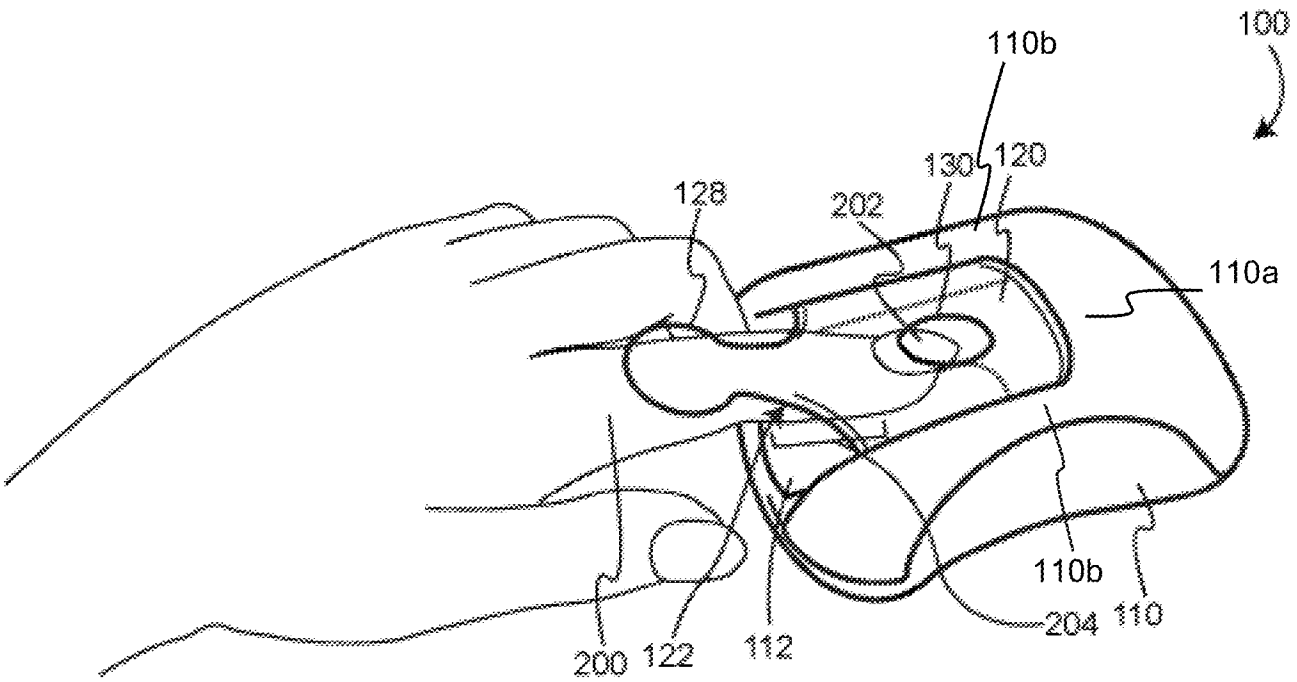
FIG. 2A is a perspective view of the embodiment of the masking apparatus of FIG. 1, where a finger of the user is supported in the masking apparatus and the cover member is in the un-extended position.
Figure 2B:
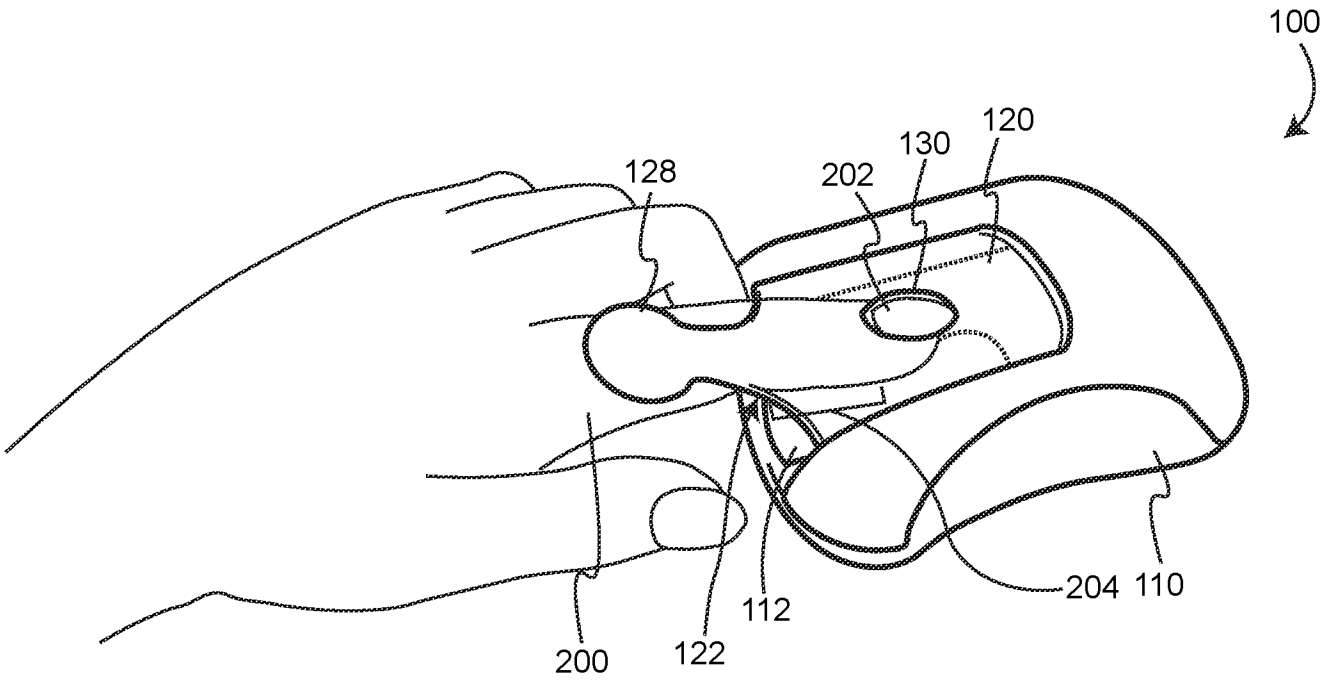
FIG. 2B is a perspective view of the embodiment of the masking apparatus of FIG. 1, where a finger of the user is supported in the masking apparatus and the cover member is in the extended position.
Figure 3:
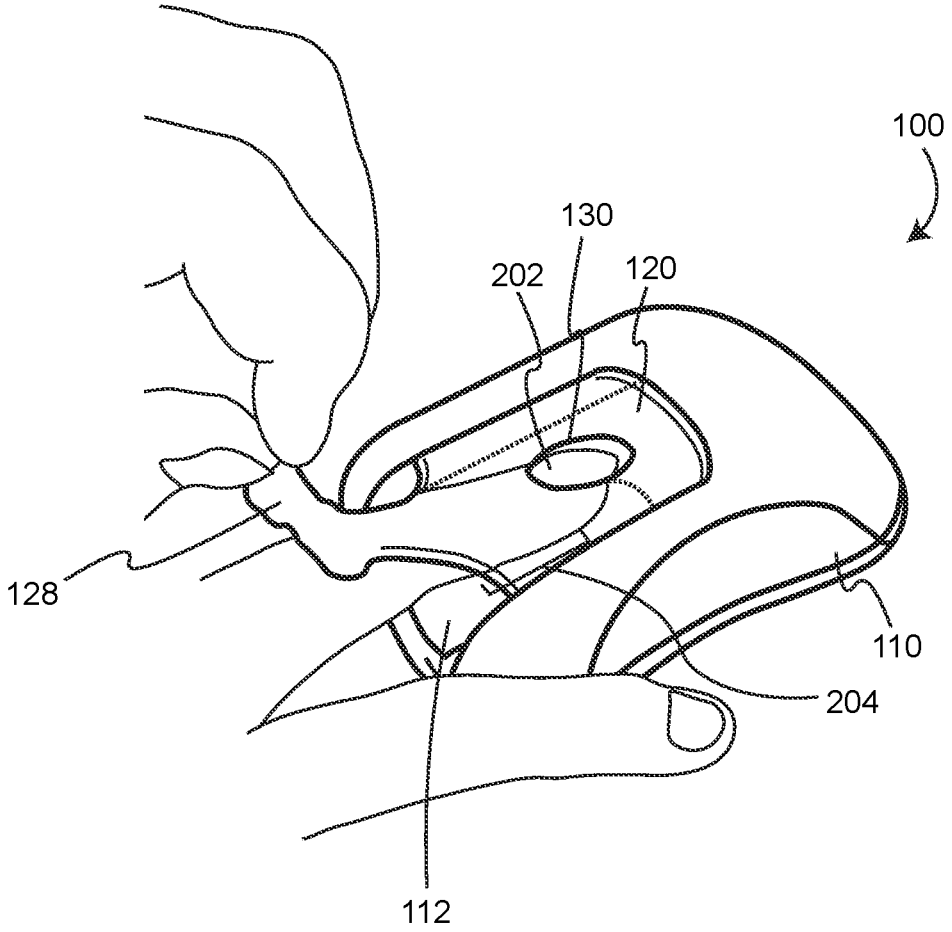
FIG. 3 is a perspective view of the embodiment of the masking apparatus of FIG. 1, where the user pulling a pull tab of the cover member for stretching the cover member to the extended position.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures, and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one."

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

As used in this document, "attached" in describing the relationship between two connected parts includes the case in which the two connected parts are "directly attached" with the two connected parts being in contact with each other, and the case in which the connected parts are "indirectly attached" and not in contact with each other, but connected by one or more intervening other part(s) between.

As used in this document, terms describing relative positions of elements such as 'top', 'upper', 'bottom', 'lower', or other analogous terms will be understood to refer to the placement of the described element during use of the apparatus of which it is a part. As an example, if reference is made to a device having an upper member, it will be understood that the upper member is being described as having an upper position when the device that it is a part of is in use or is in position for use, unless the context would make it clear that it is otherwise.

As used herein, the terms "comprises" and "comprising" are to be construed as being inclusive and open ended, and not exclusive. Specifically, when used in the specification and claims, the terms "comprises" and "comprising," and variations thereof mean the specified features, steps or components are included. These terms are not to be interpreted to exclude the presence of other features, steps, or components.

As used herein, the terms "about" and "approximately" are meant to cover variations that may exist in the upper and lower limits of the ranges of values, such as variations in properties, parameters, and dimensions.

Modifications, additions, or omissions may be made to the apparatus and methods described herein without departing from the scope of the disclosure. "Each" refers to each member of a set or each member of a subset of a set.

The embodiments described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the disclosure, therefore, is only to be limited by the claims appended hereto and any amendments made thereto.

The present disclosure provides a masking apparatus 100 for use in shielding a finger 200 of a user when a product, such as a cosmetic product, is being applied to a fingernail 202 on the finger 200 of the user.

Referring to FIGS. 1 to 5, there is provided an embodiment of the masking apparatus 100 for shielding the finger 200 of the user when the product is being applied to the fingernail 202 on the finger 200 of the user. The masking apparatus 100 includes a base 110 with a finger rest 112, where the finger rest 112 is formed for supporting the finger 200 of the user. Referring to FIG. 2A, the base 110 includes a main portion 110*a* and a pair of arm portions 110*b* that extend away from the main portion 110*a* so as to define a gap between the pair of arm portions 110*b* and the main portion 110*a*. When the finger 200 of user is supported on the finger rest 112, the main portion 110*a* is positioned distal to the fingernail 202 of the finger 200 of the user, and the pair of arm portions 110*b* extend from the main portion 110*a* toward a proximal portion the finger 200 of the user that is proximal relative to the fingernail 202. The masking apparatus also includes a cover member 120 that is connected to the base 110, and more particularly fixedly connected to the main portion 110*a* and the arm portions 110*b* of the base 110 so as to span the gap between the pair of arm portions 110*b* and the main portion 110*a*. The cover member 120 has a through-aperture 130 that is formed through the cover member 120 and that is made from an elastic material so as to be elastically stretchable, away from the main portion 110*a* of the base 110 and toward the proximal portion of the finger 200 of the user, from an un-extended position (see FIG. 2A) to an extended position (see FIG. 2B) so as to position the through-aperture 130 at least partially over the fingernail 202, when the finger 200 of the user is placed on the base 110. The cover member 120 includes an engagement portion that has an underside 122 that is positioned to engage a proximal portion 204 of the finger 200 of the user when the cover member 120 is in the extended position (as shown in FIG. 2B), where the proximal portion 204 of the finger 200 is proximal relative to the fingernail 202. The underside 122 of the engagement portion of the cover member 120 has a selected coefficient of friction with human skin so as to releasably retain the cover member 120 in the extended position by friction during engagement of the underside 122 with the proximal portion 204 of the finger 200 of the user.

For applying the product to the fingernail 202 on the finger 200 of the user, the product is applied to the fingernail 202 via the through-aperture 130. By structuring the masking apparatus 100 such that the through-aperture 130 is positioned at least partially over the fingernail 202 in the extended position, the through-aperture 130 will direct the product towards the fingernail 202, while the cover member 120 surrounding the through-aperture 130 will protect the proximal portion 204 of the finger 200 of the user from the product.

In an additional embodiment such as shown in FIGS. 1 to 5, the through-aperture 130 is shaped such that when the through-aperture 130 is at least partially positioned over the fingernail 202 on the finger 200 of the user (i.e., when the finger 200 of the user is placed on the base 110 and the cover member 120 is stretched from the un-extended position to the extended position), the fingernail 202 of the finger 200 is at least partially received within the through-aperture 130 on the cover member 120.

Figure 6:
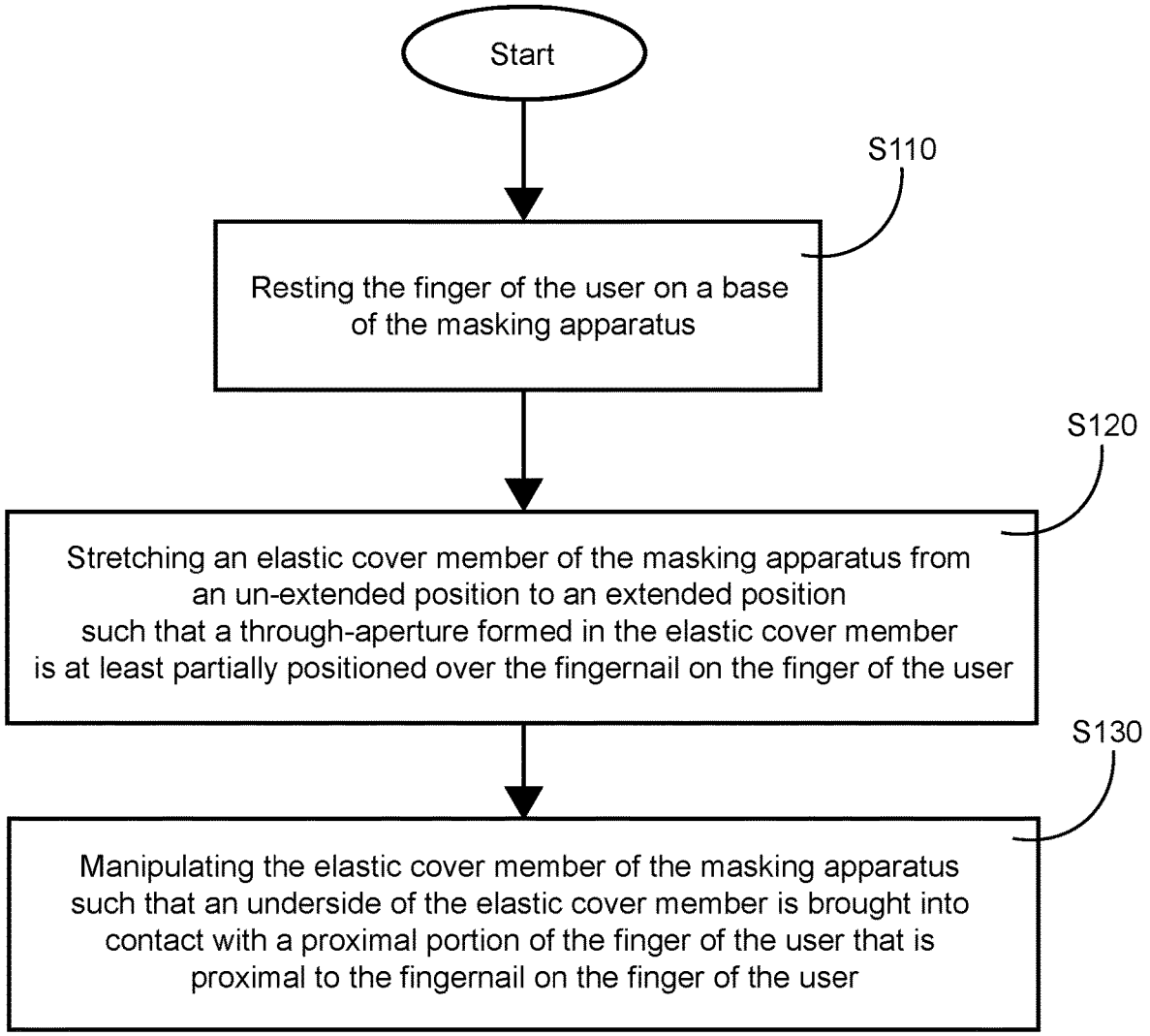
FIG. 6 is a flow chart of the method of using the masking apparatus according to another aspect of the present disclosure.

In an embodiment such as shown in FIG. 6, the present disclosure provides a method of use for the masking apparatus 100 in shielding the finger 200 of the user when the product is applied to the fingernail 202 on the finger 200. The method of use for the masking apparatus 100 includes a first step S110 of resting the finger 200 of the user on the base 110 of the masking apparatus 110, and a second step S120 of stretching the cover member 120 of the masking apparatus 100 from an un-extended position to an extended position such that the through-aperture 130 formed in the cover member 120 is at least partially positioned over the fingernail 202 on the finger 200 of the user. As provided previously, the cover member 120 is connected to the base 110 of the masking apparatus 120 for stretching between the un-extended and extended positions. The method of use for the masking apparatus 100 also includes a step S130 of manipulating the cover member 120 of the masking apparatus 100 such that the underside 122 of the cover member 120 is brought into contact with the proximal portion 204 of the finger 200 of the user that is proximal to the fingernail 202 on the finger 200 of the user. As provided previously, the underside 122 of the cover member 120 has the selected coefficient of friction with human skin so as to releasably retain the cover member 120 in the extended position by friction during the contact of the underside 122 of the cover member 120 with the proximal portion 204 of the finger 200 of the user. In some embodiments, the through-aperture 130 is shaped such that when the cover member 120 is stretched from the un-extended position to the extended position and the through-aperture 130 is at least partially positioned over the fingernail 202 on the finger 200 of the user, a portion of the fingernail 202 on the finger 200 is at least partially received within the through-aperture 130 on the cover member 120.

Said another way, the use of the masking apparatus 100 involves a user first resting their finger 200 on the finger rest 112 of the base 110. The user then pulls on the cover member 120 in a direction such that the cover member 120 stretches from the un-extended to extended positions (and thereby increases in length) for aligning the through-aperture 130 at least partially over the fingernail 202 on the finger 200 of the user. As the cover member 120 is stretched into the extended position, the underside 122 of the cover member 120 is brought into contact with the proximal portion 204 of the finger 200 of the user that is positioned proximal to the fingernail 202. The selected coefficient of friction of the underside 122 of the cover member 120 provides the degree of friction between the underside 122 of the cover member 120 and at least the proximal portion 204 of the finger 200 of the user for holding the cover member 120 in the extended position. By holding the cover member 120 in place in the extended position, the through-aperture 130 is maintained in position at least partially over the fingernail 202 of the finger 200 of the user such that the product can be properly applied to the fingernail 202 through the through-aperture 130. When the cover member 120 is in the extended position, the cover member 120 and through-aperture 130 may be arranged relative to the fingernail 202 of the finger 200 of the user in several ways.

In an additional embodiment, the method of use for the masking apparatus 100 further includes a step of applying the product to the fingernail 202 on the finger 200 of the user via the through-aperture 130 of the cover member 120.

Figure 5:
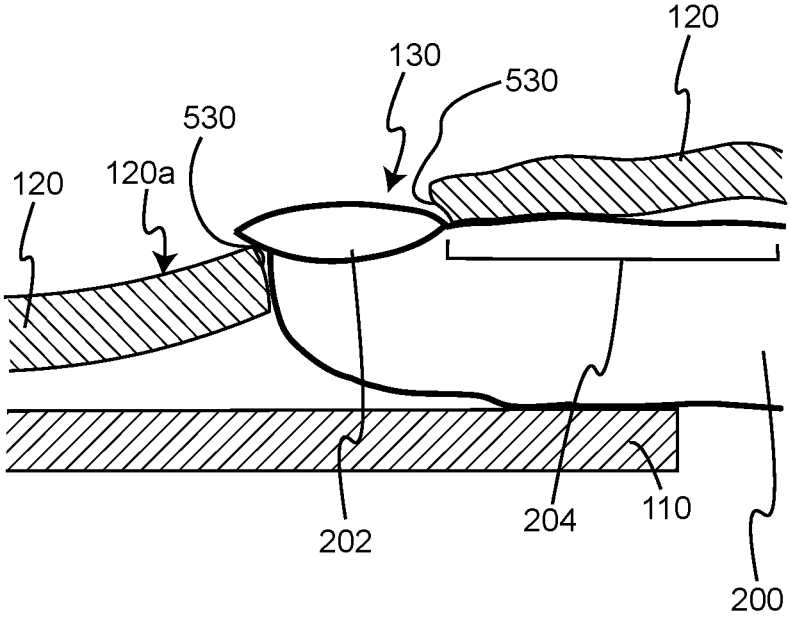
FIG. 5 is a section view of the masking apparatus according to the embodiment provided in FIG. 1, where the cover portion of the masking apparatus has been pulled into the use position around the proximal portion of the finger.

In another additional embodiment, the method of use for the masking apparatus 100 further includes a step of manipulating the cover member 120 of the masking apparatus 100 such that a portion of the finger 200 of the user and/or a portion of the fingernail 202 on the finger 200 abuts an edge 530 of the through-aperture 130 for retaining the cover member 120 in the extended position (see FIG. 5). In this embodiment, the through-aperture 130 of the cover member 120 is sized to receive at least part of the finger 200 and/or the fingernail 202 on the finger 200 when the cover member 120 is pulled to the extended position and the through-aperture 130 is positioned over the fingernail 202. When the at least part of the finger 200 and/or the fingernail 202 on the finger 200 is received in the through-aperture 130, the at least part of the finger 200 and/or the fingernail 202 on the finger 200 will abut against the edge 530 of the through-aperture 130. In this configuration, the at least part of the finger 200 and/or the fingernail 202 which abuts against the edge 530 of the through-aperture 130 will oppose the elastic forces present in the cover member 120 which will tend to bias the cover member 120 back towards the un-extended position when the cover member 120 is stretched away from the un-extended position. In this way, the at least part of the finger 200 and/or the fingernail 202 which abuts against the edge 530 of the through-aperture 130 will work to retain the cover member 120 in the extended position and thereby retain the through-aperture 130 in position at least partially over the fingernail 202.

In this embodiment, the combined effect of the friction forces applied due to the selected coefficient of friction of the underside 122 of the cover member 120 and the retaining effect of the at least part of the finger 200 and/or the fingernail 202 which abuts against the edge 530 of the through-aperture 130 will cooperate to retain the cover member 120 in the extended position and thereby retain the through-aperture 130 in position at least partially over the fingernail 202.

In yet another additional embodiment, the method of use for the masking apparatus 100 further includes a step of manipulating the cover member 120 of the masking apparatus 100 such that a portion of the fingernail 202 on the finger 200 of the user extends through the through-aperture 130 in the cover member 120 and rests upon a top face **120*a* of the cover member 120 for further retaining the cover member 120 in the extended position (see FIG. 5). In this embodiment, the through-aperture 130 is formed such that when the cover member 120 is pulled to the extended position and the through-aperture 130 is positioned over the fingernail 202, a first portion of the fingernail 202 (such as a distal portion of the fingernail 202 that extends past an end of the finger 200) will be received by the through-aperture 130 and will extend through the through-aperture 130 to rest upon the top face 120***a* of the cover member 120, while a second portion of the fingernail 202 or a portion of the finger 200 will be received in the through-aperture 130 and will abut against the edge 530 of the through-aperture 130. Like the above-described retaining effect of the at least part of the finger 200 and/or fingernail 202 which abuts against edge 530 of the through-aperture 130, the first and second portions of the fingernail 202 which contacts the top face 120*a* of the cover member 120 and through-aperture 130 of the cover member 120, respectively, will oppose the elastic forced present in the cover member 120 which urge the cover member 120 towards the un-extended position. In this embodiment, the combined contacting of the top face 120*a* and abutting of the through-aperture 130 of the cover member 120 by the fingernail 202 and/or finger 200, as well as the friction forces applied due to the selected coefficient of friction between the underside 122 of the cover member 120 and the finger 200 of the user, cooperate to retain the cover member 120 in the extended position and thereby retain the through-aperture 130 in position at least partially over the fingernail 202

As provided above, the cover member 120 is connected to the base 110 and is made from an elastic material so as to be elastically stretchable from the un-extended position to the extended position (see FIGS. 2A and 2B) such that the through-aperture 130 can be positioned relative to the fingernail 202. The cover member 120 as disclosed herein can be formed of various elastic materials that suitably elastically stretchable to provide for stretching of the cover member 120 between the un-extended and extended positions. These elastic materials include but are not limited to elastomers, thermoset polymers, rubbers, synthetic rubber materials, and synthetic rubber-plastic hybrid materials.

In an exemplary embodiment, the cover member 120 is formed from an elastic silicone material.

In an additional embodiment, the cover member 120 is formed such that the selected coefficient of friction of the underside 122 of the engagement portion of the cover member 120 is in a range from 0.3 to 1.7, preferably 0.4 to 1.2, more preferably 0.55 to 0.68, and more preferably in a range from 0.60 to 0.64. It will be understood however that other lower (and of course, higher) coefficients of friction between the cover member 120 at least the proximal portion 204 of the finger 200 of the user could be provided for holding the cover member 120 in the extended position.

In an embodiment, the selected coefficient of friction of the underside 122 of the engagement portion of the cover member 120 is provided by an inherent frictional characteristic of the elastic material of the cover member 120.

In an alternate embodiment, the selected coefficient of friction of the underside 122 of the engagement portion of the cover member 120 is provided by a secondary material that is applied to the underside 122 of the engagement portion of the cover member 120 so as to provide the selected frictional characteristic to the underside 122. For example, the secondary material can be an at least partially adhesive material that will provide the selected coefficient of friction between the underside 122 of the engagement portion and the finger 200 of the user, and which is applied to the underside 122 of the cover member 120. The at least partially adhesive material that is applied to the underside 122 of the cover member 120 will result in the application of friction forces to the underside 122 of the cover member 120 by the finger 200 of the user for retaining the cover member 120 in the extended position when the underside 122 of the cover member 120 is brought into contact with the finger 200.

The cover member 120 as disclosed herein can be connected to the base 110 by various means and in various configurations. For example, at least some of the edges of the cover member 120 can be mounted to the base 110 via an adhesive that is disposed on the base 110. Alternatively, the cover member 120 can be securely fixed to the base 110 via a plurality of securing elements, such as screws or rivets, which can be mounted through the cover member 120 and securely received in corresponding apertures on the base 110.

The cover member 120 as disclosed herein can have a variety of shapes and forms that are suitably for frictionally engaging the finger 200 of the user for retaining the cover member 120 in the extended position.

In an embodiment such as shown FIGS. 1 to 5, the cover member 120 has a partially rectangular form that includes partially rectangular top and bottom faces, as well as a first end and a pair of lateral sides. The cover member 120 is structured such that each of the first end and the pair of lateral sides of the cover member 120 are connected to the base 110 for connecting the cover member 120 to the base 110.

In the specific embodiment provided in FIGS. 1 to 5, the cover member 120 includes a first cover member portion and a second cover member portion. The first cover member portion has a substantially rectangular form and includes the first end and pair of lateral sides that are connected to the base 110. The first cover member portion includes the through-aperture 130 and defines the engagement portion of the cover member 120 such that the underside 122 of the engagement portion is formed on a lower surface of the first cover portion of the cover member 120.

In some embodiments of the cover member 120, the first and second cover member portions are formed as parts of a single, integral cover member. In other embodiments of the cover member 120, the first and second cover member portions are separate parts that are secured together to form the cover member 120.

In an additional embodiment such as shown in FIGS. 1 to 5, the cover member 120 includes a pull tab 128 that extends from an end of the cover member 120. The pull tab 128 is generally shaped to be grasped by the user (see FIG. 3) for stretching the masking portion of the cover member 120 from the un-extended position towards the extended position.

In the specific embodiment provided in FIGS. 1 to 5, the pull tab 128 of the cover member 120 defines the second cover member portion of the cover member 120. The pull tab 128 includes a pull tab neck 128*a* and a pull tab grasping region 128*b* that is formed on an end of the pull tab neck 128*a* and that is wider than the pull tab neck 128*a*. The pull tab neck 128*a* is connected to the first cover member portion and extends outwards from the first cover member portion. The pull tab neck 128*a* is connected to the first cover member portion such that the pull tab 128 is laterally aligned with the through-aperture 130 on the cover member 120.

As provided above, the cover member 120 also includes the through-aperture 130 that is formed in the cover member 120. In the specific embodiment provided in FIGS. 1 to 5, the through-aperture 130 extends between the partially rectangular top and bottom faces of the cover member 120. The through-aperture 130 is arranged inwardly on the cover member 120 for being positioned at least partially over the fingernail 202 of the finger 200 of the user when the cover member 120 is stretched (see FIG. 3) to the extended position.

In an additional embodiment of the through-aperture 130, the through-aperture 130 has a nail-like shape that generally corresponds to a shape of the fingernail 202 on the finger 200 of the user.

In another additional embodiment, the through-aperture 130 of the cover member 120 is sized to be smaller than the fingernail 202 on the finger 200 of the user such that when the cover member 120 is stretched to the extended position and the through-aperture 130 is positioned over the fingernail 202, the through-aperture 130 is stretched around the fingernail 202 and the cover member 120 applies an inward elastic force on the fingernail 202 for retaining the fingernail 202 within the through-aperture 130. In this way, the fingernail 202 of the user is even more securely retained in position within the through-aperture 130 and the positioning of the cover member 120 for protecting the proximal portion 204 of the finger 200 of the user is well-maintained.

In an embodiment, the through-aperture 130 of the cover member 120 is sized such that a maximum diameter of the through-aperture 130 in an unstretched position is less than a maximum length of the fingernail 202 on the finger of user. While the size of the fingernail 202 on the finger of the user will vary for different users, it is known that the average length of fingernails for men will vary from approximately 9.4 mm to approximately 15.7 mm, while the average length of fingernails for adult women will vary from approximately 9.0 mm to approximately 15.6 mm (see Jung, J. W., Kim, K. S., Shin, J. H., Kwon, Y. J., Hwang, J. H., & Lee, S. Y. (2015). Fingernail Configuration. *Archives of plastic surgery,* 42(6), 753-760. https://doi.org/10.5999/aps.2015.42.6.753). Accordingly, in some embodiments of the through-aperture 130, the through-aperture 130 is sized such that the maximum diameter of the through aperture 130 is less than 9.0 mm. In other embodiments, the through-aperture 130 is sized such that the maximum diameter of the through aperture 130 is in a range from 9.0 mm to 15.7 mm.

In yet another embodiment where the user of the masking apparatus 100 is a child, the through-aperture 130 is sized such that the maximum diameter of the through aperture 130 is in a range from 6.0 mm to 9.0 mm, and more particularly in a range from 6.5 mm to 7.5 mm.

The base 110 of the masking apparatus 100 as disclosed herein can have various forms and configurations. The base 110 is generally structured to include a substantially flat bottom surface which rests on an external surface during the use of the masking apparatus 100. The base 110 is also formed to support the finger 200 of the user via the finger rest 112 as the product is being applied to the fingernail 202 of the user and the cover member 120 is shielding the finger 200 of the user. In the specific embodiments provided in FIGS. 1 to 3, the base 110 has a rectangular form and includes an opening formed in an upper portion thereof. The cover member 120 is mounted to the base 110 such that the cover member 120 extends across the opening while providing a gap through which the finger 200 of the user can be inserted.

In an embodiment, the base 110 of the masking apparatus 100 is composed of a suitably rigid and strong plastic material selected from a list including but not limited to high- and low-density polyethylene (LDPE, HDPE), polypropylene (PP), polyvinylchloride (PVC), polystyrene (PS, ABS), polycarbonate (PC), and polyester (PET).

In an embodiment where the cover member 120 includes the first end, the first end of the cover member 120 is mounted to a first end of the base 110.

In some embodiments, the finger rest 112 is integrally formed with the base 110 for supporting the finger 200 of the user while in other embodiments, the finger rest 112 is formed as part of the base 110, but is releasably mounted to the rest of the base 110 such that the finger rest 1123 can be separated from the rest of the base 110.

In a first embodiment of the finger rest 112, the finger rest 112 includes a top surface that is angled towards the first end of the base 110 for supporting the finger 200 of the user at an angle relative to a bottom surface of the base 110.

In a second embodiment of the finger rest 112, the finger rest 112 is oriented for supporting the finger 200 of the user at a non-zero angle relative to the cover member 120 so as to drive the proximal portion 204 of the finger 200 of the user into engagement with the engagement portion of the cover member.

While the embodiments provided in FIGS. 1 to 6 show the finger rest 112 formed as a structure that projects up from the base 110 or lower base member 410*a* such that the top of the finger rest 112 is positioned at a vertically upward position relative to the surfaces surrounding the finger rest 112, this need not be the case. In other embodiments, the finger rest 112 can be formed such that the top of the finger rest 112 is substantially aligned with the surfaces surrounding the finger rest 112.

Figure 4A:
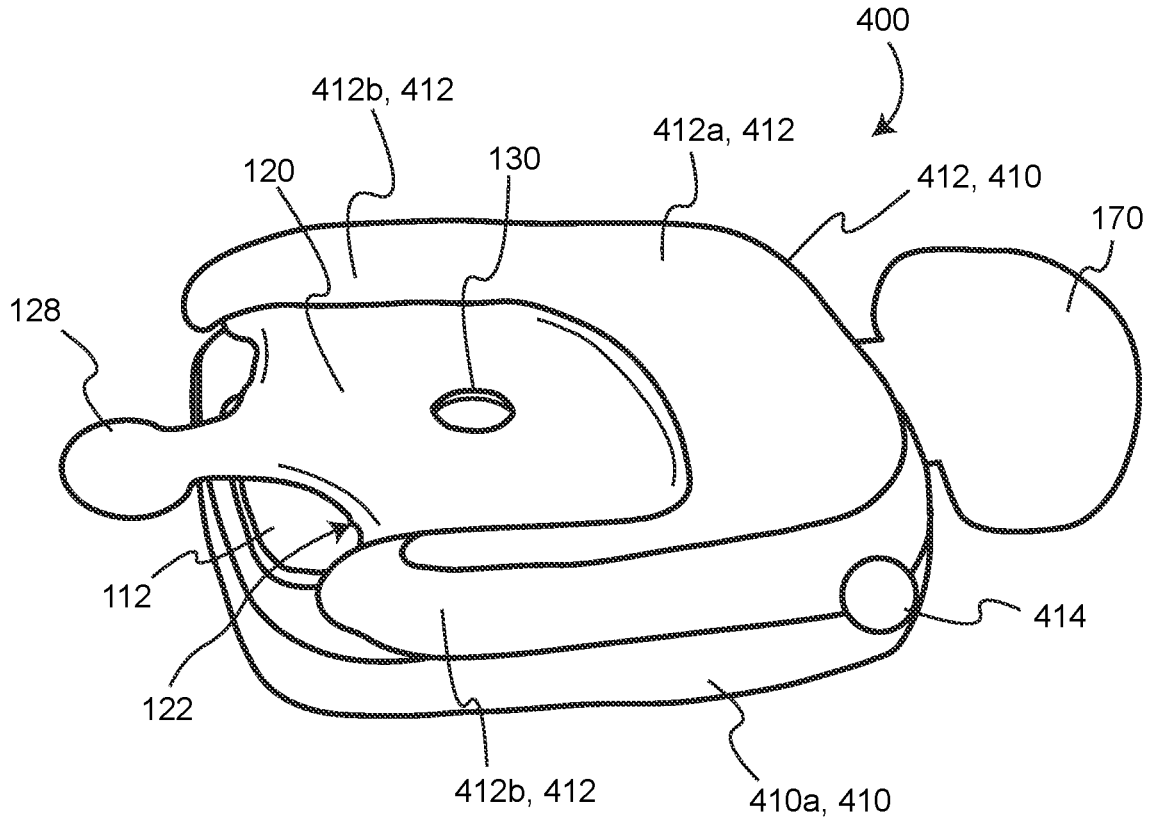
FIG. 4A is a perspective view of another embodiment of the masking apparatus of the present disclosure, where the base of the masking apparatus is a multi-part base.
Figure 4B:
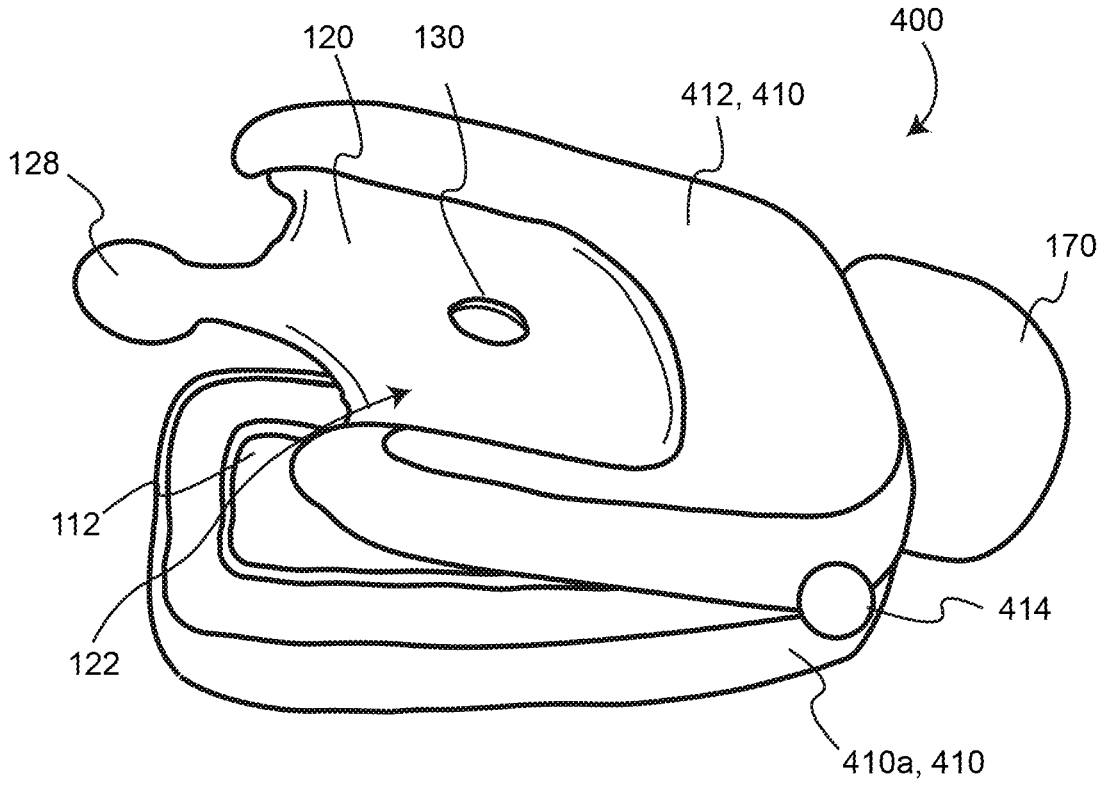
FIG. 4B is a perspective view of the masking apparatus according to the embodiment of FIG. 4A, where the base of the masking apparatus is a multi-part base, and the upper base member is in a loading position.

The base 110 of the masking apparatus 100 can have various forms and configurations which facilitate different functionalities. In an embodiment such as the one shown in FIGS. 4A and 4B, the masking apparatus 100 is formed as a multi-part masking apparatus 400, and the base 110 is formed as a multi-part base 410 that is manipulatable for repositioning the cover member 120 relative to the finger 200 of the user when the finger 200 of the user is supported on the finger rest 112 on the base 410. In the embodiment such as shown in FIGS. 4A and 4B where the base 110 is the multi-part base 410, the multi-part base 410 includes a lower base member 410*a* that has a support surface for supporting the finger 200 of the user where the support surface is define on the finger rest 112. The multi-part masking apparatus 400 also includes a upper base member 412 that is movably mounted to the lower base member 410*a* for moving about the lower base member 410*a* between a loading position (see FIG. 4B) and a use position (see FIG. 4A) where the upper base member 412 is supported atop the lower base member 410*a*. In some embodiments, the multi-part masking apparatus 400 includes all of the aforementioned features and elements of the masking apparatus 100.

In an additional embodiment, the upper base member 412 is hingedly mounted to the lower base member 410*a* by at least one hinge element 414 such that the upper base member 412 can pivot about the lower base member 410*a* between the use and loading positions.

In another additional embodiment shown in FIGS. 4A and 4B, the multi-part masking apparatus 400 is formed such that the cover member 120 is connected to only the upper base member 412 of the base 110, and such that the upper base member 412 is movably connected to the lower base member 410*a* for movement directly away from the lower base member 410*a* so as to inhibit disturbance of any product (such as nail polish) on the fingernail 202. Since the cover member 120 is only connected to the upper base member 412 and the upper base member 412 is movably connected to the lower base member 410*a*, any movement of the upper base member 412 relative to the lower base member 410*a* will also move the cover member 120 relative to the lower base member 410*a*. By moving the cover member 120 relative to the lower base member 410*a*, the cover member 120 can be separated from the finger and fingernail 202 of the user once a product has been applied to the fingernail 202 of the user so as to prevent any disturbance (such as smearing or smudging) of the product on the fingernail 202 by the cover member 120, and so as to prevent any seepage of product on the cover member 120 down onto the finger 200 of the user.

In the specific embodiment provided in FIGS. 4A and 4B, the upper base member 412 is hingedly mounted to the lower base member 410*a* such that in the use position, the upper base member 412 sits atop the lower base member 410*a*. The upper base member 412 and lower base member 410*a* have forms of corresponding size. The upper base member 412 includes a main portion 412*a* and a pair of arm portions 412*b* that extend parallel to each other, away from the main portion 412*a* so as to define a gap therebetween. The cover member 120 is fixedly connected to the main portion 412*a* and to the pair of arm portions 412*b* of the upper base member 412 so as to span the gap between the pair of arm portions 412*b* and the main portion 412*a*.

In an embodiment where the base 110 is the multi-part base 410, and where the base 110 includes the finger rest 112, the lower base member 410*a* is formed to include the finger rest 112 such that the finger rest 112 defines the support surface of the lower base member 410*a* for supporting the finger 200 of the user.

In the specific embodiment provided in FIGS. 4A and 4B, the finger rest 112 is positioned on the lower base member 410*a* to be directly below the cover member 120 when the upper base member 412 is in the use position on top of the lower base member 410*a*.

In an embodiment where the base 110 of the multi-part masking apparatus 400 is structured as the multi-part base 410, the multi-part base 410 is formed to control the movement of the lower base member 410*a* and the upper base member 412 relative to one another.

In an additional embodiment where the base 110 is the multi-part base 410, at least one of the upper base member 412 and lower base member 410*a* include a connector element that is structured for releasably securing the upper base member 412 to the lower base member 410*a* when the upper base member 412 is in the use position on top of the lower base member 410*a*. In this way, the upper base member 412 can be maintained in the use position while the product is being applied to the fingernail 202 on the finger 200 of the user and will be prevented from moving relative to the lower base member 410*a*.

In an additional embodiment, the multi-part base 410 of the multi-part masking apparatus 400 further includes at least one biasing element (not shown) that is connected between the lower base member 410*a* and the upper base member 412 for biasing the upper base member 412 towards the loading position. The at least one biasing element of the multi-part masking apparatus 400 can have various forms corresponding to the form of the multi-part base 410. For example, in embodiments where the upper base member 412 and lower base member 410*a* are hingedly connected by the hinge element 414, the multi-part base 410 can include the at least one biasing element in the form of a helical spring that is operably connected to the hinge element 414 for biasing the upper base member 412 and lower base member 410*a* apart, towards the loading position.

In another additional embodiment such as shown in FIGS. 4A to 4B, the bulti-part base 410 further includes an actuator button 170 that is operably connected to the connector element, and that is actuatable by the user for actuating the connector element such that the upper base member 412 can move from the use position towards the loading position and separates from the lower base member 410*a*. In this way, when the multi-part base 410 includes the actuator button 170, the connector element, and the at least one biasing element for biasing the upper base member 412 towards the loading position, the actuator button 170 of the base 110 can be actuated to release the connector element that is holding the upper base member 412 and lower base member 410*a* together in the use position, and the at least one biasing element will then drive the upper base member 412 towards the loading position.

In the specific embodiment provided in FIGS. 4A and 4B, the button 170 is movably mounted to the multi-part base 410 and includes a button head that is shaped to be grasped by the user. The button 170 is movably mounted to the multi-part base 410 to slide relative to the multi-part base 410 between actuated (FIG. 4B) and unactuated (FIG. 4A) positions. The button 170 is connected to the connector element such that as the button is moved between the actuated and unactuated positions the button will engage the connector element for releasing the connector element.

The specific embodiments described above have been shown by way of example, and it should be understood that these embodiments may be susceptible to various modifications and alternative forms. It should be further understood that the above-described embodiments are intended to be examples of the present disclosure and alterations and modifications may be affected thereto, by those of skill in the art, without departing from the scope of the disclosure that is defined solely by the claims appended hereto.

What is claimed is:

1. A masking apparatus for shielding a finger of a user when a product is being applied to a fingernail on the finger of the user, the masking apparatus comprising:

a base that includes a lower base member and an upper base member;

wherein the lower base member includes a finger rest to support the finger of the user and a substantially flat bottom surface for resting on an external surface during use of the masking apparatus;

wherein the upper base member includes a main portion and a pair of arm portions that extend substantially perpendicularly from the main portion so as to define a gap between the arm portions; and a cover member that is fixedly connected to each of the main portion and the arm portions of the upper base member so as to span the gap, wherein the cover member has a through-aperture that is formed therein, and the cover member is made from an elastic material to be elastically stretchable away from the main portion of the base from an un-extended position to an extended position to position the through-aperture at least partially over the fingernail when the finger of the user is placed on the finger rest;

wherein the cover member includes an engagement portion that has an underside that is positioned to engage the portion of the finger of the user that is proximal to the fingernail when the cover member is in the extended position; and wherein the underside has a coefficient of friction with human skin so as to retain the cover member in the extended position by friction during engagement of the underside with the proximal portion of the finger of the user.

2. The masking apparatus of claim 1, wherein the cover member has a partially rectangular form that includes a first end and a pair of lateral sides, and wherein the first end and the pair of lateral sides are connected to the upper base member.

3. The masking apparatus of claim 2, wherein the main portion of the upper base member is mounted to a first end of the lower base member, and wherein the finger rest includes a top surface that is angled towards the first end of the lower base member for supporting the finger of the user at an angle relative to the bottom surface of the base.

4. The masking apparatus of claim 1, wherein the finger rest is oriented for supporting the finger of the user at a non-zero angle relative to the cover member so as to drive the portion of the finger of the user proximal to the fingernail into engagement with the engagement portion of the cover member.

5. The masking apparatus of claim 1, wherein the upper base member that is movably mounted to the lower base member for moving the upper base member between an open loading position and a closed use position where the upper base member is supported atop the lower base member.

6. The masking apparatus of claim 5, wherein the cover member is connected to only the upper base member, and wherein the upper base member is movably connected to the lower base member for movement directly away from the lower base member so as to inhibit disturbance of any nail polish on the fingernail.

7. The masking apparatus of claim 5, wherein the upper base member is hingedly mounted to the lower base member.

8. The masking apparatus of claim 5, wherein at least one of the upper base member and lower base member include a connector element that is structured for releasably securing the upper base member to the lower base member when the upper base member is in the closed use position on the lower base member.

9. The masking apparatus of claim 8, wherein the base further includes at least one biasing element that is connected between the lower base member and the upper base member for biasing the upper base member towards the open loading position.

10. The masking apparatus of claim 9, wherein the base further includes an actuator button that is operably connected to the connector element and that is actuatable by the user for actuating the connector element such that the upper base member moves from the closed use position towards the open loading position and separates from the lower base member.

11. The masking apparatus of claim 1, wherein the cover member includes a pull tab extending from an end of the cover member, and wherein the pull tab is shaped to be grasped by the user for stretching the masking portion of the cover member from the un-extended position towards the extended position.

12. The masking apparatus of claim 1, wherein the through-aperture is sized such that the maximum diameter of the through-aperture is less than 9.0 mm.

13. A method of using a masking apparatus to shield a finger of a user when applying a product to a fingernail on the finger of the user, the method comprising:

resting the finger of the user on a finger rest of a base of the masking apparatus, wherein the base includes a lower base member including the finger rest and a substantially flat bottom surface that rests on an external surface, wherein the base includes an upper base member including a main portion and a pair of arm portions that extend substantially perpendicular from the main portion so as to define a gap between the pair of arm portions, and when the finger of the user is supported on the finger rest, the main portion is proximal to the fingernail and distal from a palm to which the finger is attached and the pair of arm portions extend from the main portion towards the palm of the user;

stretching an elastic cover member of the masking apparatus, away from the main portion of the base and toward the palm of the user, from an un-extended position to an extended position such that a through-aperture formed in the elastic cover member is at least partially positioned over the fingernail on the finger of the user, the elastic cover member being fixedly connected to the main portion and the arm portions of the base of the masking apparatus for stretching between the un-extended and extended positions; and manipulating the elastic cover member of the masking apparatus such that an underside of the elastic cover member is brought into contact with the portion of the finger of the user that is proximal to the fingernail, the underside of the elastic cover member having a coefficient of friction with human skin so as to retain the elastic cover member in the extended position by friction during contact of the underside of the elastic cover member with the proximal portion of the finger of the user.

14. The method of claim 13, further comprising:

applying the product to the fingernail on the finger of the user via the through-aperture of the elastic cover member.

15. The method of claim 13, wherein the through-aperture is shaped such that when the elastic cover member is stretched from the un-extended position to the extended position and the through-aperture is at least partially positioned over the fingernail on the finger of the user, a first portion of the fingernail on the finger is at least partially received within the through-aperture on the cover member.

16. The method of claim 15, further comprising:

manipulating the elastic cover member of the masking apparatus such that a portion of the finger of the user and/or a portion of the fingernail on the finger abuts an edge of the through-aperture for further retaining the elastic cover member in the extended position.

17. The method of claim 15, further comprising:

manipulating the elastic cover member of the masking apparatus such that a portion of the fingernail on the finger of the user extends through the through-aperture in the cover member and rests upon a top face of the cover member for further retaining the elastic cover member in the extended position.

* * * * *